United States Patent [19]

Hawkins

[11] Patent Number: 4,616,496

[45] Date of Patent: Oct. 14, 1986

[54] ROTOPEENING APPARATUS HAVING A FLEXIBLE SPINDLE

[75] Inventor: Phillip J. Hawkins, Penn Hills Township, Allegheny County, Pa.

[73] Assignee: Westinghouse Electric Corp., Pittsburgh, Pa.

[21] Appl. No.: 731,241

[22] Filed: May 7, 1985

[51] Int. Cl.[4] ..... B24C 3/16; C21D 7/06

[52] U.S. Cl. ..... 72/53

[58] Field of Search ..... 72/53, 110, 199, 234, 72/362, 365; 51/241 B

[56] References Cited

U.S. PATENT DOCUMENTS

| | | |
|---|---|---|
| 3,485,073 | 12/1969 | Burney . |
| 3,531,964 | 10/1970 | Manning, Jr. et al. . |
| 3,648,498 | 3/1972 | Voss et al. . |
| 3,654,786 | 4/1972 | Koenecke et al. . |
| 3,834,200 | 9/1974 | Winter . |
| 3,857,750 | 12/1974 | Winter et al. . |
| 3,886,774 | 6/1975 | Stromstedt et al. . |
| 4,034,585 | 7/1977 | Straub . |
| 4,354,371 | 10/1982 | Johnson . |
| 4,481,802 | 11/1984 | Harman et al. . |

FOREIGN PATENT DOCUMENTS

| | | |
|---|---|---|
| 2551966 | 8/1983 | France . |

OTHER PUBLICATIONS

"Longer Life for Metal Parts by Shot Peening", R. R. Murray, *Machine Design,* Mar. 22, 1984, pp. 57–61.

U.S. application Ser. No. 613,674, filed May 24, 1984 for "Device for Shot-Peening Inside Surface of U-Bend Region of Heat Exchanger Tubing", by Douglas Harman, et al.

Technical Brochure entitled "3M Brand Roto Peen Flap Assemblies Type TC 330", Building Service and Cleaning Products Division of 3M Corp., Cleveland, Ohio.

*Primary Examiner*—Leon Gilden

*Attorney, Agent, or Firm*—L. A. DePaul

[57] ABSTRACT

A rotopeening apparatus utilizing a flexible spindle for rotopeening the inside wall of tubes of limited access is disclosed herein. The spindle is formed from a flexible, rotatable housing and includes a mandrel having eighteen peening flappers connected thereto along its axis of rotation. The mandrel is rotatably mounted within the housing in an off-center orientation relative to the longitudinal axis of the spindle in order that the peening flapper may rotate and orbit within the tube when the mandrel and the housing are rotated. The apparatus includes a frame plate for detachably mounting the flexible spindle within the open end of the tube to be rotopeened. The spindle is mounted in cantilever off the side of the frame plate to maximize its manipulability in areas of limited access. Additionally, the drive motors of the apparatus are remotely coupled to the peening spindle by means of flexible shafts in order to maximize portability. The apparatus is particularly useful for rotopeening heat exchange tubes mounted in the peripheral regions of the tubesheets of nuclear steam generators.

31 Claims, 14 Drawing Figures

32
34a
7
13a
52a
13b
50a
13c
13d
13e
13f
42a
31a
252
290
261
253
262
154
291
156
210
258
30
259
31b
152
150
190
265
256
75
184
208b
172
186
208a
82
176
213
123
125
127
117
119
121
80
115
225
237
234

ROTOPEENING APPARATUS HAVING A FLEXIBLE SPINDLE

BACKGROUND OF THE INVENTION

1. Field of the Invention

This invention relates to a device capable of peening the interior walls of tubes located in areas of limited accessibility. It is particularly useful in rotopeening the heat exchange tubes which are mounted in the peripheral areas of the tubesheet of a nuclear steam generator in order to relieve tensile stresses in the inside wall of these tubes.

2. Description of the Prior Art

Devices for peening the inside walls of metallic tubes are generally known in the prior art. Such devices are particularly useful in relieving or at least equilibrating the tensile stresses which may be induced across the wall of a metallic tube when that tube is radially expanded, as by a hydraulic mandrel or a cold-rolling tool. Such stress-causing expansions are routinely performed in the heat exchange tubes of nuclear steam generators, particularly in the vicinity of the generator tubesheet, both during the manufacture and maintenance of the nuclear steam generator. Unfortunately, such tensile stresses can lead to an undesirable phenomenon known as "stress corrosion cracking" in the walls of such tubes if these stresses are not relieved.

In order to fully understand the dangers associated with such stress corrosion cracking, and the utility of the invention in preventing such cracking, some general background as to the structure, operation and maintenance of nuclear steam generators is necessary.

Nuclear steam generators are comprised of three principal parts, including a secondary side and a tubesheet, as well as a bowl-shaped primary side which circulates water heated from a nuclear reactor. The secondary side of the generator includes a plurality of U-shaped tubes, as well as an inlet for admitting a flow of feedwater. The inlet and outlet ends of the U-shaped tubes within the secondary side of the generator are mounted in the tubesheet which hydraulically separates the primary side of the generator from the secondary side. The primary side in turn includes a divider sheet which hydraulically isolates the inlet ends of the U-shaped tubes from the outlet ends. Hot, radioactive water flowing from the nuclear reactor is admitted into the section of the primary side containing all of the inlet ends of the U-shaped tubes. This hot, radioactive water flows through these inlets, up through the tubesheet, and circulates around the U-shaped tubes which extend within the secondary side of the generator. As it circulates, this water transfers its heat through the walls of the U-shaped tubes to the non-radioactive feedwater flowing through the secondary side of the generator, thereby converting the feedwater to non-radioactive steam which in turn powers the turbines of an electric generator. After the water from the reactor circulates through the U-shaped tubes, it flows back through the tubesheet, through the outlets of the U-shaped tubes, and into the outlet section of the primary side, where it is recirculated back to the nuclear reactor.

The walls of the heat exchange tubes in such nuclear steam generators can suffer a number of different forms of corrosion degradation, including denting, stress corrosion cracking, intragranular attack, and pitting. In situ examination of the tubes within these generators has revealed that most of this corrosion degradation occurs in what are known as the crevice regions of the generator. The principal crevice region for each of the U-shaped tubes is the annular space between the heat exchange tube and the bore in the tubesheet through which the tube extends. Corrosive sludge tends to collect within this crevice from the effects of gravity. Moreover, the relatively poor hydraulic circulation of the water in this region tends to maintain the sludge in this annular crevice, and to create localized "hot spots" in the tubes adjacent the sludge. The heat radiating from these "hot spots" acts as a powerful catalyst in causing the exterior walls of the heat exchange tubes to chemically combine with the corrosive chemicals in the sludge.

While most nuclear steam generators include blowdown systems for periodically sweeping the sludge out of the generator vessel, the sludges in the tubesheet crevice regions are not easily swept away by the hydraulic currents induced by such systems. Despite the fact that the heat exchange tubes of such generators are typically formed from corrosion-resistant Inconel stainless steel, the combination of the localized regions of heat and corrosive sludge can ultimately cause the walls of the heat exchange tubes to crack, and to leak radioactive water from the primary side into the secondary side of the generator, thereby radioactively contaminating the steam produced by the steam generator.

In order to prevent such corrosion and tube-cracking from occurring in the annular crevices surrounding the tubes in the tubesheet, various processes have been developed for radially expanding the sections of the tubes extending through the tubesheets so as to eliminate, or at least minimize, the annular space between the bores in the tubesheet and the heat exchange tubes. Such radial expansions may be implemented by hydraulic mandrels capable of applying fluid pressures of near 10,000 psi across selected sections of the tubes, or by cold-rolling tools which utilize pitched, tapered rollers capable of screwing into and widening the open ends of the tubes. However, such tube expansions create tensile stresses throughout the walls of the tubes in the tubesheet region which render them more susceptible to corrosion, thereby partially defeating the purpose of the tube expansion. Because the metal around the inner diameter of the tube was expanded a relatively greater amount than the metal forming the outer diameter of the tube, most of the tensile stress caused by the radial expansion was concentrated in the inner wall of the tube.

In order to relieve this tensile stress, shot peening processes were developed for hardening the inner walls of the expanded tubes. Such shot peening processes generally employed a nozzle which was slidably insertable through the open ends of the tubes in the tubesheet and which was capable of radially firing a large volume of tiny zirconia balls against the inner wall of the tube. The resulting high-velocity impingement of the hard, zirconia "shot" relieved much of the stress in the tube walls by compressibly work-hardening the inner wall of the tube. Since stress corrosion (and consequent cracking) seems to occur only in those regions of the tube walls which have undergone a threshold stress of between 10 and 15 kilo-pounds per square inch, the stress relief of the inner wall regions which suffered the maximum stress substantially reduced the likelihood of stress corrosion.

Unfortunately, such prior art shot-peening processes are not without shortcomings. For example, if the motion of the peening nozzle along the longitudinal axis of the tube is not carefully controlled, a non-uniform peening pattern may result in the interior wall of the tube. Worse yet, if the peening nozzle should accidentally remain stationary for any significant amount of time during the shot-peening process, the high-velocity balls of zirconia can create new stress patterns in the walls of the tube which exceed the threshold stress limit for stress corrosion cracking to occur, and might even break completely through the tube walls, depending upon how long they remain stationary within the tube. Still other problems arise from the fragmented zirconia which becomes stuck in the inner walls of the tubes. Such fragments must be cleaned out of these tubes by means of a rotating, abrasive tool. This not only necessitates another time-consuming (and hence expensive) step in the maintenance procedure, but also creates a cloud of radioactive zirconia dust which may contaminate non-radioactive areas of the plant if this dust is not captured and disposed of properly. Additionally, the constant recirculation of the peening shot tends to change its peening characteristics, which in turn adversely affects the uniformity of the peening pattern created in the inner walls of the tubes even when the nozzle is moved at a uniform speed through the tube.

While rotopeening devices are known which are capable of peening and stress-relieving the inner walls of these tubes without the problems associated with the use of rotating peening flappers rather than high velocity zirconia balls, such mechanisms have other shortcomings which are at least as serious as those associated with zirconia shot-peening. Some of these mechanisms are difficult, if not impossible, to use in the heat exchange tubes located in the periphery of the tubesheet due to the fact that the open ends of these tubes are directly adjacent the inner wall of the bowl-shaped vessel which forms the primary side of the nuclear steam generator. To appreciate the spatial limitations imposed by the bowl and tubesheet geometry in such generators, reference is made to the various figures of U.S. Pat. No. 4,262,402 (assigned to Westinghouse Electric Corporation) which illustrate a side, cross-sectional view of the tubesheet and bowl configuration present in such nuclear steam generators. Still another shortcoming of such prior art rotopeening devices is the lack of any means to accurately control the amount and uniformity of the peening applied to the inner walls of such tubes. Specifically, such mechanisms have no means whatever for accurately oscillating the peening flappers within the tube so that the flappers accurately and uniformly peen the inner walls of the tube to an extent which is great enough to provide substantial stress relief on the inner wall of the tube while avoiding an over-stress condition on the outer wall of the tube.

Clearly, there is a need for a peening apparatus capable of quickly and uniformly peening the inner walls of the heat exchange tubes mounted around the periphery of the tubesheet of a nuclear steam generator. Ideally, such an apparatus should be able to simultaneously peen the walls of more than one tube in order to minimize the time (and hence the expense) of the peening procedure. Finally, such an apparatus should be able to apply enough peening to the inner walls of the tubes to relieve tensile stresses without inducing other corrosion-inducing stresses in the outer tube walls and without necessitating a separate abrasion step which creates a cloud of potentially contaminating radioactive dust.

SUMMARY OF THE INVENTION

In its broadest sense, the invention is a rotopeening apparatus for rotopeening the inside wall of a conduit which comprises at least one peening spindle having a flexible housing. The flexible housing is preferably rotatably mounted, and may contain a mandrel having at least one peening means, such as a peening flapper, operatively connected thereto. The flexible housng preferably also includes at least one bearing for rotatably mounting the mandrel within the housing off-center relative to the longitudinal axis of the housing so that the preening flapper rotates and orbits within the conduit when the mandrel and housing are rotated.

The flexible spindle housing may be formed from a plurality of articulated joints, such as dog-leg joints. The flexibility of the spindle housing and mandrel contained therein renders the apparatus particularly useful in peening conduits having open ends of limited access, such as the heat exchange tubes which are mounted around the periphery of a tubesheet in a nuclear steam generator. The apparatus may further include a frame for detachably mounting the flexible peening spindle in the vicinity of a peripherally located tube in such a tubesheet, and the spindle may be connected to this frame in cantilever fashion by means of a tapered plate in order to facilitate the installation of the flexible spindle within the open end of a peripherally located tube.

The apparatus of the invention further includes a rotary and orbital drive assembly for simultaneously rotating the mandrel and flexible housing of the spindle, as well as an oscillatory drive assembly for indexing and reciprocating the spindle within the tube being peened. However, in order to maximize the ability of the apparatus to be installed in areas of limited accessibility, both the rotary and orbital drive assembly and the drive motor of the oscillatory drive assembly are preferably remotely coupled to the spindle mandrel of the flexible spindle by means of flexible shafts. In order to further minimize the space requirements of the apparatus, the flexible shaft which remotely couples the rotary and orbital drive assembly with the mandrel and flexible housing of the spindle is preferably coaxial.

BRIEF DESCRIPTION OF THE SEVERAL FIGURES

DETAILED DESCRIPTION OF THE PREFERRED EMBODIMENT

General Overview of the Structure and Function of the Invention

Figure 1:
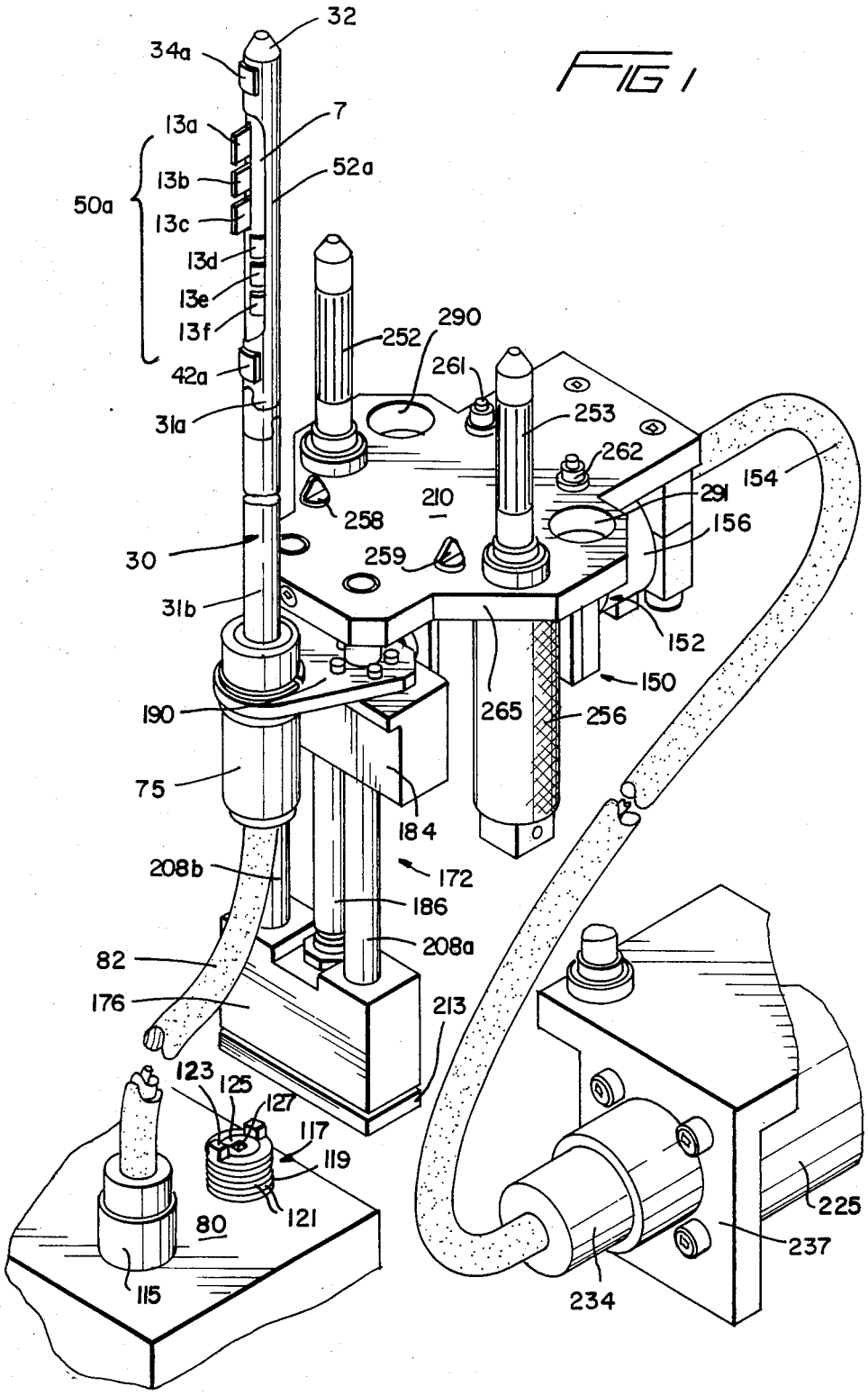
FIG. 1 is a perspective view of the preferred embodiment of the rotopeening apparatus of the invention, shown with one flexible spindle.
Figure 2:
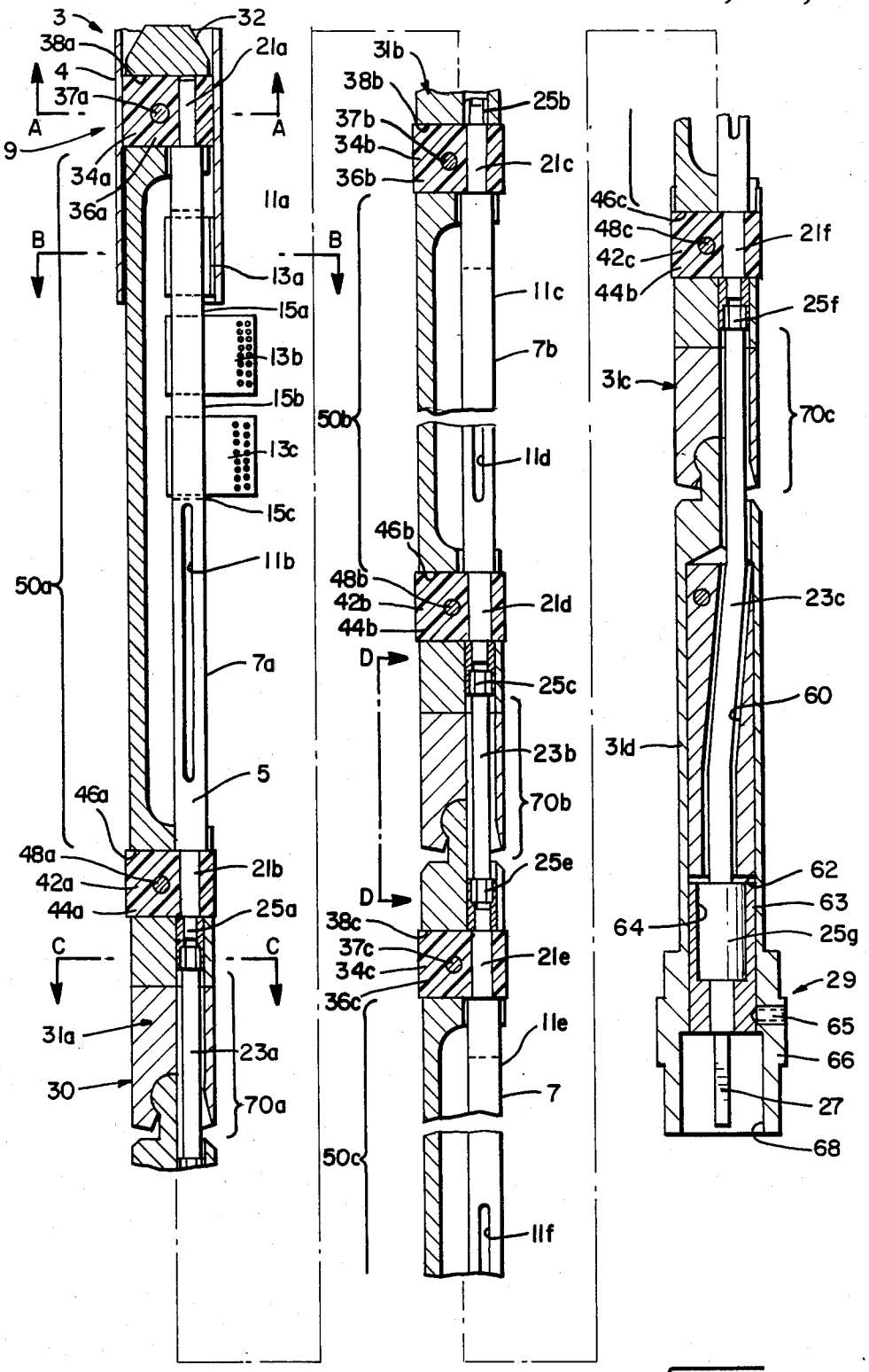
FIG. 2 is a cross-sectional side view of the flexible spindle.

With reference to FIGS. 1 and 2, wherein like numerals designate like components throughout all of the several Figures, the rotopeening apparatus 1 of the invention generally comprises a flexible peening spindle 3 which is remotely coupled to the output gearbox 80 of a rotary and orbital drive assembly by means of a flexible coaxial shaft 82. The apparatus 1 further comprises an oscillatory drive assembly 150 having a reciprocating mechanism 152 and an indexing mechanism 172 which is remotely coupled to a drive motor 225 by means of another flexible shaft 154. Both the reciprocating mechanism 152 and the indexing mechanism 172 are suspended beneath a frame plate 210 which includes a pair of expandable collets 252,253 for securing the plate 210 in abutting relationship with the tubesheet of a nuclear steam generator. Finally, the rotopeening apparatus 1 includes a tapered plate 190 for cantilevering the flexible peening spindle 3 off the side of the indexing mechanism 172 in order to render it easier to insert the spindle 3 within heat exchange tubes 4 which are peripherally located near the bowl of the nuclear steam generator. It should be noted at the outset that the flexibility of the spindle housing 30, the remote coupling of both the spindle 3 and the reciprocating and indexing mechanisms 152,172 from their respective drivers by means of flexible shafts 82 and 154, and the side positioning of the spindle afforded by the tapered plate 190 all contribute to provide a rotopeening device 1 which is highly portable, and particularly adapted to peening the interior walls of tubes 4 located in areas of limited accessibility.

Specific Description of the Structure and Function of the Invention

With reference now to FIGS. 2, 3A, 3B and 3C, the flexible spindle 3 is insertable within a heat exchange tube 4, and contains a rotatable mandrel 5 which is journalled in an off-center relationship with respect to the longitudinal axis of the spindle 3. The mandrel 5 of the spindle 3 includes three rigid, enlarged sections 7 near the distal end 9, the central portion, and the proximal end 29 of the spindle 3, respectively. These enlarged sections 7 each include two slots 11*a*–11*b*, 11*c*–11*d*, and 11*e*–11*f*. As is evident from FIG. 2, each of the slots in the slot pairs 11*a*–11*b*, 11*c*–11*d*, and 11*e*–11*f* is orthogonally disposed with respect to its neighbor. Each of these slot pairs receives and holes three peening flappers 13*a*–13*c*, 13*d*–13*f*, 13*g*–13*i*, 13*j*–13*l*, 13*m*–13*o*, and 13*p*–13*r*, respectively (of which only the first group of three, 13*a*–13*c*, are shown). Additionally, gaps 15*a*–15*r* are provided between each of the peening flappers 13*a*–13*r*, respectively (of which only the first group of three, 15*a*–15*c*, are shown). The orthogonal disposition of the six slots 11*a*–11*f*, in combination with the provision of gaps 15*a*–15*r* between the flappers 13*a*–13*r* advantageously increases the efficiency of the rotopeening device 1 by reducing the wind resistance of the mandrel 5, which in turn reduces the amount of torque required on the mandrel 5 to achieve a peening intensity of a desired level.

Figure 3A:
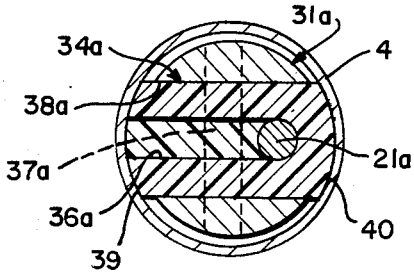
FIGS. 3A, 3B and 3C are cross-sectional views taken across lines AA, BB and CC of FIG. 2.
Figure 3C:
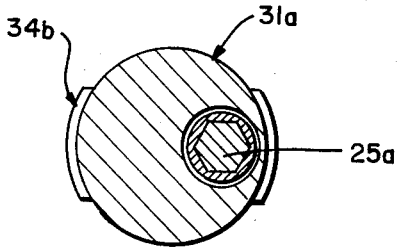
Figure 3B:
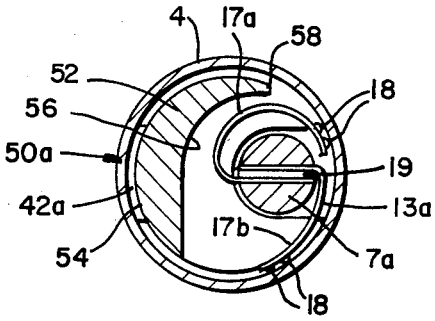
Figure 3D:
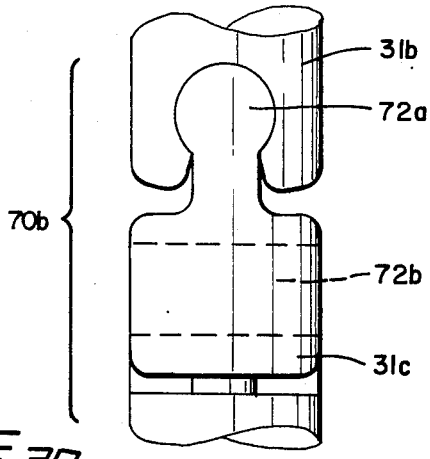
FIG. 3D is an enlargement of the section DD of FIG. 2.

As is best seen with respect to FIGS. 2 and 3B, each of the peening flappers 13*a*–13*r* includes a pair of rectangular flap leaves 17*a*, 17*b*. Each of the flap leaves 17*a*, 17*b* in turn includes an array of peening balls on its outer edge. In the preferred embodiment, two rows consisting of eight peening balls each are mounted on the outer edges of the flap leaves 17*a*, 17*b*. The peening balls 18 are about forty mils in diameter, and are formed from a hard material such as tungsten carbide. Each of the flap leaves 17*a*, 17*b* is formed from a flexible composite of fiberglass and phenolic resin. Additionally, the inner edges of each of the flap leaves 17*a*, 17*b* are laminated over a resilient mounting pad 19. The thickness of the laminate formed by the mounting pad 19 and the two inner edges of the flap leaves 17*a*, 17*b* is slightly greater than the thickness of each of the slots 11*a*–11*f* so that the peening flappers 13*a*–13*r* may be frictionally secured within the slots 11*a*–11*f* by merely inserting the resilient mounting pad 19 into its respective slot in the position illustrated in FIG. 3B. Flappers conforming to the aforementioned specifications are available from the Building Service and Cleaning Products Division of Minnesota Mining & Manufacturing Company, of Cleveland, Ohio.

With reference again to FIGS. 2 and 3A, the rigid, enlarged sections 7*a*–7*c* of the mandrel 5 include shaft portions 21*a*–21*b*, 21*c*–21*d*, and 21*e*–21*f* on each of their ends of journalling the flapper-bearing sections 7*a*, 7*b* and 7*c* of the mandrel 5 within the three pairs of self-lubricating bearings 34*a*–42*a*, 34*b*–42*b*, and 34*c*–42*c*, respectively. Each of these bearings 34*a*–34*c* and 42*a*–42*c* includes a slot 36*a*–36*c* and 44*a*–44*c* for receiving the shaft portions 21*a*–21*b*, 21*c*–21*d*, and 21*e*–21*f* of each of the enlarged sections 7*a*–7*c* of the mandrel 5. Each of these shaft portions are locked into their respective slots by means of inserts 41 which in turn are secured in place by retaining pins 37*a*–48*a*, 37*b*–48*b*, and 37*c*–48*c*. Instead of being concentrically aligned with the longitudinal axis of the spindle 3, the shaft journalling portions of each of these slots are deliberately radially displaced from the longitudinal axis of the spindle 3 so that each enlarged section 7*a*–7*c* is journalled within the spindle 3 in an off-center relationship. However, as is evident from FIG. 2, the rigid, enlarged sections 7*a*–7*c* of the mandrel 5 are generally serially connected by means of flexible shaft sections 23*a*, 23*b* and 23*c*. Cylindrical couplings 25*a*–25*g* effectively splice together the three rigid, enlarged sections 7*a*–7*c* in tandem, as indicated. In the preferred embodiment, each of the flexible shaft sections 23*a*–23*c* is a right-hand, drive-type coupling material having a 0.150 inch core diameter. Such flexible coupling material is available from Stow Manufacturing Company of Binghamton, N.Y. As is best seen in FIG. 2, the mandrel 5 terminates in a rigid, square section 27 at the proximal portion 29 of the spindle 3.

The flexible spindle housing 30 is formed from three dog-legged, cylindrical sections 31*a*–31*d*. The outer diameter of each of the cylindrical sections 31*a*–31*d* is somewhat less than the inner diameter of the wall of the tubes 4 being peened so that the spindle 3 may be easily inserted into and withdrawn from the open ends of each tubes. At its distal end 9, the top cylindrical section 31*a* terminates in an end portion 32 which is tapered to facilitate the insertion of the end of the spindle 3 into the open end of a tube 4. Immediately under the tapered end portion 32 is the previously mentioned self-lubricating bearing 34*a*. In the preferred embodiment, all the bearings 34*a*–34*c*, and 42*a*–42*c* are formed from an easily machined, self-lubricating plastic such as Delrin®. As is best seen with respect to FIGS. 2 and 3A, bearing 34*a* (and bearings 34*b* and 34*c* as well) are generally shaped like a rectangular prism whose shortest sides 39,40 are arcuate in shape to conform to the shape of the inner wall of the tube 4. The maximum outer diameter of the bearing 34*a* (as well as all of the other bearings 34*b*, 34*c* and 42*a*–42*c*) are chosen so that they are less than the inner diameter of the tubes 4 to be rotopeened, but greater than the outer diameter of the spindle housing 30. Such dimensioning provides two-point contact for each of the cylindrical sections 31*a*–31*c* within the tube 4, and prevents metal-to-metal frictional engagement between the outer surface of the spindle housing 30 and the inner surface of the tube 4 by confining all such frictional contact to a running engagement between the inner tube surface and the arcuate sides of the self-lubricating bearings 34*a*–34*c* and 42*a*–42*c*. All of the bearings 34*a*–34*c* and 42*a*–42*c* are seatable within complementary slots 38*a*–38*c* and 46*a*–46*c* located near the distal and proximal ends, respectively, of each of the cylindrical sections 31*a*–31*d*. The previously mentioned retaining pins 37*a*–37*c* and 48*a*–48*c* serve to retain these bearings 34*a*–34*c* and 42*a*–42*c* in place when inserted through mutually registrable bores present in both the sides of the bearings 34*a*–34*c* and 42*a*–42*c*, and the dog-legged cylindrical sections 31*a*–31*c* which form most of the spindle housing 30.

FIGS. 2 and 3B best illustrate the cages 50*a*–50*c* in each of the cylindrical sections 31*a*–31*c* of the spindle housing 30. To avoid prolixity, the foregoing description is confined specifically to cage 50*a*, it being understood that the mechanical details of cages 50*b* and 50*c* are identical. Generally, the cage 50*a* consists of a ligament portion 52 having a semi-circular exterior 54 and a spiral-shaped cavity 56 which terminates in a flap-receiving rounded edge 58. The ligament portion 52 maintains alignment between the shaft-journalling portions of the slots 36*a* and 44*a* during the operation of the spindle 3 by providing both integrality and rigidity to the spindle housing 30. The ligament portion 52 achieves this function with a minimum amount of erosive peening action between it and the peening balls 18 of the flappers 13*a*–13*f* by virtue of the shape of its spiral cavity 56. Finally, the spiral cavity 56 of the ligament portion 52 helps orient the rotating flapper leaves 17*a*, 17*b* into proper impinging contact with the inside wall of the tube 4. The interaction between the cavity 56 of the ligament portion 52 and the leaves 17*a*, 17*b* of the peening flappers 13*a*–13*r* is best understood with specific reference to FIG. 3B. In this Figure, flapper leaf 17*a* approaches the flapper-receiving rounded edge 58. Rounded edge 58 gently guides and deflects the flapper leaf 17*a* so that its peening balls 18 begin to assume a position wherein they will "ride" on the portion of the spiral cavity 56 having the smallest radius. The rigid portion 7*a* of the mandrel 5 is, of course, rotating counterclockwise in this Figure. The centripetal force imparted to the peening balls 18 of the flapper leaf 17*a* by the spinning mandrel 5 causes these balls to ride completely around the spiral-shaped cavity 56 of the ligament portion 52 and ultimately to assume the position of flapper leaf 17*a*, wherein the peening balls 18 are "whipped" into impinging contact with the wall of the tube 4. As will be described in more detail hereinafter under the "method description" section, the angular speed imparted to the peening balls 18 from the rotating mandrel 5 is sufficiently great enough so that the balls 18 effectively cold-work the inner wall of the tube 4 when they strike it, thereby relieving tensile stresses around the inner diameter of the tube 4. At about the same time the peening balls 18 of one of the flapper leaves whippingly strike the inner wall of the tube 4, the opposing flapper leaf has engaged the flap-receiving rounded edge 58 of the ligament 52 and begun to "ride" along the spiralled contour of cavity 56, wherein the peening strike is repeated.

In the preferred embodiment, edge 58 is rounded as shown, instead of sharply tapered. Surprisingly, the applicants have found that a rounded edge is more resistant to wear from the peening balls 18 than a knife-type edge. While the mandrel 5 rotates the peening flappers 13*a*–13*r* in a counterclockwise direction, the cage 50*a* also rotates in a counterclockwise direction about the longitudinal axis of the tube 4, thereby imparting an orbital component of motion to the rigid, enlarged sections 7*a*–7*c* of the mandrel 5. This orbital motion allows the peening balls 18 to uniformly strike every point around the circumference of the inner wall of the tube 4. In the preferred embodiment, this orbital component of motion is much smaller than the rotational component of motion because the mandrel 5 rotates at 3,100 rpms while the cages 50*a*–50*c* of the spindle housing 30 rotate at only about 15.5 rpms.

As has been previously indicated, as the spindle housing 30 rotates within a tube 4, the outer surfaces of self-lubricating bearings 30*a*–30*c* and 42*a*–42*c* contact the inner walls of the tube 4 in running engagement. Because the outer diameters of the self-lubricating bearings 34*a*–34*c* and 42*a*–42*c* are chosen so as to be only slightly smaller than the inner diameter of the tube 4, the pairs of bearings 34*a*, 42*a*, 34*b*, 42*b*, and 34*c*, 42*c* maintain a uniform "stand-off" distance between the peening leaves 17*a*, 17*b* of the flappers 13*a*–13*r* as the spindle housing 30 rotates within the tube 4. As used herein, the term "stand-off distance" is defined as the radial distance between the inner edge of the flapper leaves 17*a*, 17*b* and the inner surface of the tube 4. In the preferred embodiment, a stand-off distance of between 60 and 100 mils is used. As will be described in detail hereinafter, the maintenance of a uniform stand-off distance is an important feature of the structure of the invention, since peening intensity is dependent in part on the amount of stand-off distance between the mandrel 5 and the peening balls 18.

With further reference to FIG. 2, the spindle housing 30 further includes a bottom cylindrical section 30*d* whose proximal end is detachably connectable with the output gearbox 80 of a rotary and orbital drive assembly by way of a flexible shaft 82. Specifically, cylindrical section 31*d* includes a shaft-housing bore 60 which is radially offset between its proximal and distal ends in order to radially displace the position of the mandrel 5 within the spindle housing 30. The proximal end of the cylindrical section 31*d* includes an internal annular shoulder 62 for capturing a bearing 63 which is preferably formed from Delrin®. Bearing 63 is secured to the proximal end of the housing 30 by a set screw 65, and includes a cylindrical recess for journalling cylindrical coupling 25g. The terminal portion of the section 31d includes an annular shoulder 67 as shown, and forms a male end 66 of a cylindrical coupling 75. Cylindrical coupling 75 rotatably connects the proximal end of the spindle housing 30 and the rigid, square shaft 27 of the mandrel 5 to the output gearbox 80 of the aforementioned rotary and orbital drive assembly. The interior 68 of the male end 66 is hexagonally shaped for a purpose which will become evident shortly.

Turning now to FIG. 3C, each of the cylindrical sections 31a–31d are pivotally connected to one another by means of dog-leg joints 70a, 70b and 70c. Again, to avoid prolixity, the foregoing description is confined to dog-leg joint 70b, it being understood that the structure of dog-leg joints 70a and 70c are identical. Dog-leg joint 70b includes two pivot joints 72a, 72b which are orthogonally disposed to one another about the longitudinal axis of the spindle 3. In the preferred embodiment, any one of a number of pivot joints 72a, 72b may be used. Accordingly, the precise details of the structure of these joints forms no part of the instant invention. However, it should be noted that a pivot point which allows a maximum rotation of approximately 10° about the longitudinal axis of the spindle 3 is preferred. Spindle housings 30 which incorporate pivot joints 72a, 72b which are movable within the aforementioned 10° off-axis limit are flexible enough to be easily inserted and used within the most peripherally located heat exchange tubes in the tubesheet of a nuclear steam generator, and yet maintain a sufficient amount of rigidity so as to be easily alignable with and insertable into the open ends of such tubes. Additionally, the 10° off-axis limit of each of the dog-leg joints 70a–70c prevents the spindle housing 30 from overbending and damaging the flexible sections 23a–23c of the mandrel 5.

Figure 4:
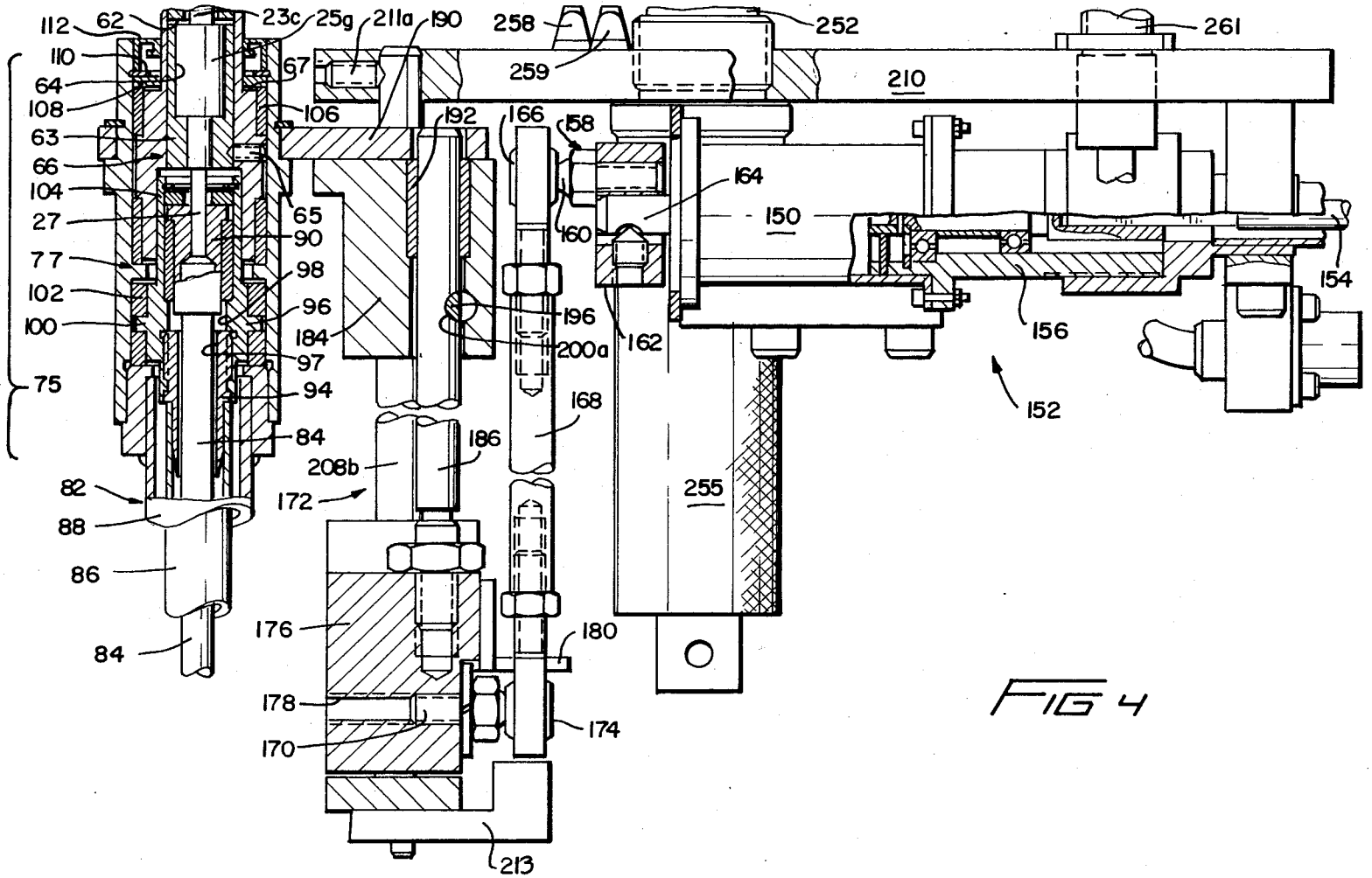
FIG. 4 is a partial, cross-sectional side view of the apparatus of the invention.

Turning now to FIG. 4, the cylindrical coupling 75 includes a female end 79 for receiving the previously described male end 66 located on the proximal end 29 of the mandrel housing 30. Cylindrical coupling 75 mechanically connects the rotatable mandrel 5 and the rotatable, flexible spindle housing 30 with the output axles of a gearbox 80 of a rotary and orbital drive assembly (shown in FIG. 1) by means of a flexible coaxial shaft 82. Coaxial shaft 82 includes an inner shaft for driving the mandrel 5 at approximately 3,200 rpms, an outer shaft 86 for driving the spindle housing at approximately 15.5 rpms, and a casing 88 for enclosing the outer shaft 86. The mandrel 5 of the spindle 3 is connected to the inner shaft 84 by means of a bronze thrust bearing 90 having a square recess 92 for receiving the square end 27 of the mandrel 5. Bronze thrust bearing 90 is circumscribed by an array of other bearings which rotatably connect the outer shaft 86 with the external annular shoulder 67 of the mandrel housing 30. Specifically, the outer shaft 86 is connected to a cable end 94 which in turn is threadedly connected to a coupling 96. Both the outer drive bearing 94 and the coupling 96 have concentrically positioned bores 97,98 in order that the inner shaft 84 may pass therethrough without interference. Additionally, coupling 96 includes a centrally disposed flange 100 circumscribing its proximal portion which is captured within an annular recess provided in a bronze thrust bearing 102. The distal end of the coupling 96 includes a hexagonally-shaped exterior 104 which is receivable within the hexagonally-shaped recess 68 within the male end 66 of the spindle housing 30. In order to secure the male end 66 within the female end 77 of the cylindrical coupling 75, the combination of an additional bearing 106, spacer 108, snap ring 110, and seal 112 are provided in the positions illustrated in FIG. 2.

Figure 5:
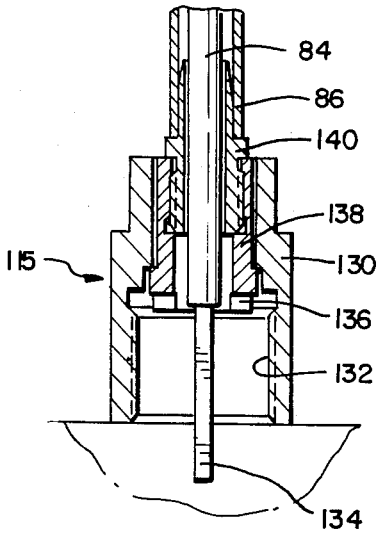
FIG. 5 is a cross-sectional side view of the socket used to couple the flexible housing and mandrel of the spindle to the output gearbox of the rotary and orbital drive means.

Turning now to FIGS. 1 and 5, the flexible coaxial shaft 82 includes another cylindrical coupling 115 for coupling its inner and outer shafts 84 and 86 to one of the outputs shafts 117 of the output gearbox of the rotary and orbital drive assembly. Each of the output shafts 117 includes an outer shaft 119 for driving the outer shaft 86 of the flexible shaft 82. Outer shaft 119 is threaded around its circumference 121 as shown. Additionally, a pair of mutually opposing keys 123 extend from the upper end of the outer shaft 119. Concentrically disposed within the outer shaft 119 is an inner shaft 125 for driving the inner shaft 84 of the coaxial shaft 82. Inner shaft 125 includes a square recess 127. A more complete description of the output gearbox 80 of the rotary and orbital drive assembly is present within the specification of U.S. patent application Ser. No. 731,260, filed the same day as the instant application, and entitled "Multi-Spindle Rotopeening Apparatus", by Bruce Bevilacqua et al, and assigned to Westinghouse Electric Corporation, the entire specification of which is expressly incorporated herein by reference.

With specific reference now to FIG. 5, the cylindrical coupling 115 includes a housing 130 having a threaded interior 132 which may be screwed over the threaded exterior 121 of the output shaft 117. The square end of the inner shaft 84 is receivable within the square recess 127 of the inner shaft 125 when the housing 130 is threadedly engaged over the exterior of the output shaft 117. Additionally, the proximal end of the outer shaft 86 includes a pair of opposing recesses 136 for receiving the pair of keys 123 present on top of the outer shaft 119 of the output shaft 117. The proximal ends of both the outer shaft 86 and inner shaft 84 are rotatably mounted both with respect to the housing 130 and each other by means of captured flange 138 which is threadedly engaged to coupling 140 in the configuration illustrated. Again, flange 138 and coupling 140 include concentrically disposed bores in order that the inner shaft 84 may extend therethrough without mechanical interference. It should be noted that the remote coupling of the rotatable mandrel 5 and flexible spindle body 30 to the output shafts 117 of the gearbox 80 by means of the flexible coaxial shaft 82 increases the portability of the flexible spindle 3, and hence greatly enhances the operator's ability to easily rotopeen steam generator tubes 4 in areas of limited accessibility.

Figure 7:
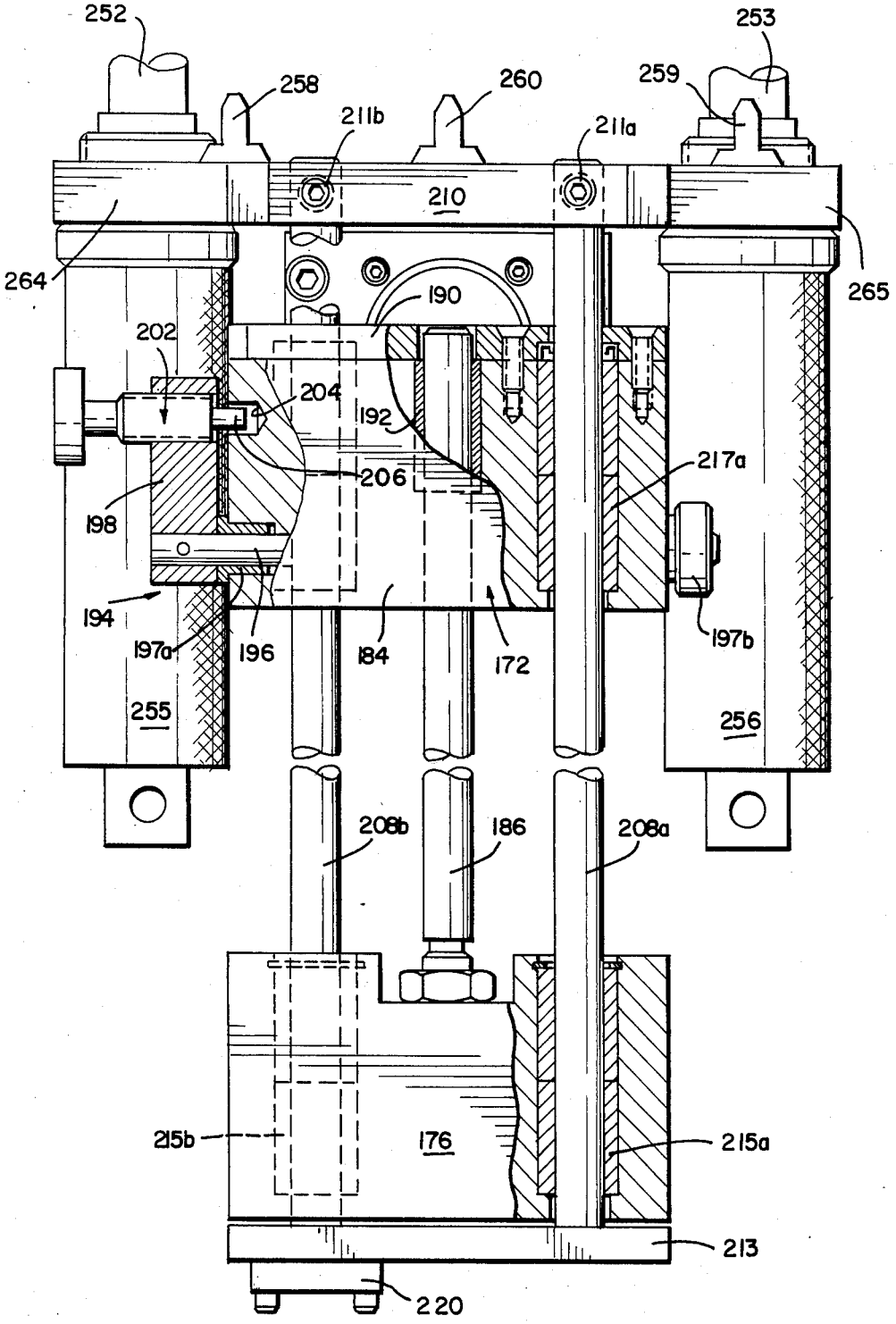
FIG. 7 is a partical cross-sectional front view of the frame plate and indexing and reciprocating mechanism of the invention.
Figure 8:
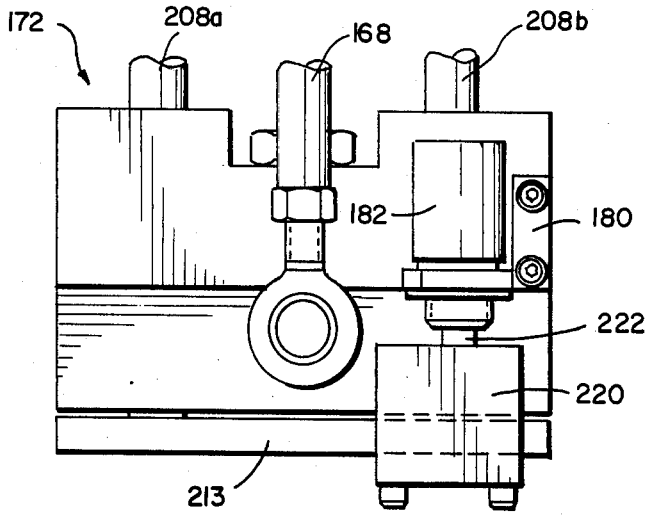
FIG. 8 is a partial, back view of the reciprocating block of the oscillator drive assembly in FIG. 7, and FIGS. 9, 10 and 11 are the tapered connecting plates used to mount one, two or three flexible spindles onto the frame of the apparatus.

With reference now to FIGS. 4 and 7, the rotopeening device 1 of the invention also includes an oscillatory drive assembly 150 for indexing and reciprocating the flexible spindle 3 within a tube 4 during the rotopeening process. The oscillatory drive assembly 150 includes a reciprocating mechanism 152 and an indexing mechanism 172. Reciprocating mechanism 152 includes a drive train formed from a flexible input shaft 154 connected to a planetary gear mechanism 156, which in turn is coupled to a crank assembly 158. The crank assembly 158 includes a crank member 160 and an eccentric 162 which is rotatably connected to the output shaft 164 of the planetary gear mechanism 156. In the preferred embodiment, the crank member 160 is radially adjustable with respect to the generally circular eccentric 162 in order to render the amplitude of the reciprocatory motion afforded by the reciprocating mechanism 152 adjustable. While not specifically shown, such adjustability can be achieved with a series of radially spaced bores for receiving the crank member 160. The crank member 160 is rotatably mounted within a bearing 166 located at the distal end of a rocker arm 168. The proximal end of the rocker arm 168 is pivotally mounted onto the input shaft 170 of the indexing mechanism 172 by means of another bearing 174. The indexing mechanism 172 generally controls the extent to which the flexible peening spindle 3 is inserted within the open end of the tube 4 to be rotopeened. As will be explained in more detail hereinafter, such a means for positioning the spindle 3 at discrete distances within the tube 4 is necessary if the inner wall of the tube 4 is to be uniformly rotopeened a longitudinal distance equivalent to the length of the spindle 3. Indexing mechanism 172 generally includes a lower block 176 having a centrally disposed threaded bore 178 for receiving the threaded end of the previously mentioned shaft 170. With specific reference now to FIGS. 4 and 8, lower block 176 further includes a bracket 180 for supporting a switch 182 which generates an electric signal whenever the rocker arm 168 reciprocates the lower block 176 in a manner which will become evident shortly.

With reference back to FIGS. 4 and 7, lower block 176 is connected to an upper block 184 by means of a drive rod 186. Generally speaking, drive rod 186 transfers the reciprocatory motion imparted to the block 176 by the rocker arm 168 to the upper block 184, which is in turn connected to the peening spindle 3 by means of tapered plate 190. Upper block 184 may be vertically indexed into at least two positions along the longitudinal axis of the drive rod 186 by virtue of bushing 92 which sidably receives the distal end of the drive rod 186, and index lock shaft assembly 194 which locks the upper block 184 into a desired position along the longitudinal axis of the drive rod 186. Specifically, the index lock shaft assembly 194 includes a semicircular shaft 196 which is selectively pivotable within the upper block 184 by means of crank 198. Semicircular shaft 196 is rotatably mounted within the upper block 184 by means of a split collar 197*b*. The semicircular shaft 196 is receivable within one of two semicircular recesses 200*a*, 200*b* (of whch only 200*a* is shown in FIG. 4) within the drive rod 186. The upper block 184 (and hence the tapered plate 190 and its attached peening spindle 3) are illustrated in the upper index position in FIG. 4. However, when the operator wishes to slide the upper block 184 and the attached peening spindle 3 into a lower index position, he merely grasps the head 201 of a spring plunger 202 which is biased into a cylindrical recess 204 in the upper block 184, withdraws the locking finger 206 of the spring plunger 202 from the recess 204, and rotates crank 198 downwardly 180°. This motion in turn rotates the semicircular shaft 196 by 180°, thereby disengaging it from the semicircular recess 200*a* present in the drive rod 186. The operator then slides the upper block 184 downwardly until the semicircular shaft 196 is aligned with the semicircular notch 200*b* (not shown) in the lower part of the drive rod 186, rotates the crank upwardly 180°, and reinserts the locking finger 206 back into the recess 204 in the upper block 184. This locks the upper block 184 (and the tapered guide plate 190 with its attached peening spindle 3) into a lower index position.

In order to maintain the upper and lower blocks 184 and 176 in alignment with one another, the indexing mechanism 172 also includes a pair of guide rods 208*a*, 208*b* whose upper ends are secured within the frame plate 210 of the rotopeening device 1 by means of set screws 211*a*, 211*b*, and whose lower ends are secured within a block support plate 213. Guide rods 208*a*, 208*b* are slidably received within the lower block 176 by means of cylindrical bushings 215*a*, 215*b*, and within the upper block 184 by means of cylindrical bushings 217*a*, 217*b*. Because the lower block 176 is connected to rocker arm 168 and is slidably movable in the vertical direction with respect to the block support plate 213, lower block 176 reciprocates relative to the plate 213 whenever the reciprocating mechanism 152 of the oscillatory drive assembly 150 is operated. Accordingly, a switch actuation bracket 220 is provided on the block support plate 213 for actuating the plunger 222 of the previously described switch 182 whenever lower block 176 reciprocates, as is best seen with respect to FIG. 8.

Figure 6:
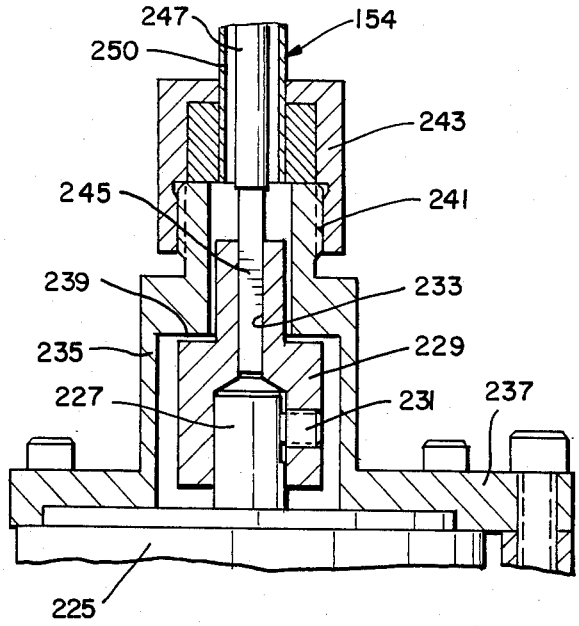
FIG. 6 is a cross-sectional side view of a socket for connecting the indexing and reciprocating mechanism to the oscillatory drive motor of the invention.

With reference now to FIGS. 4 and 6, the reciprocating mechanism 152 of the oscillatory drive assembly 150 is powered by means of an electric motor 225 having an output shaft 227 which is remotely coupled to the planetary gear mechanism 156 by means of the previously mentioned flexible input shaft 154. Specifically, a shaft adapter 229 is mounted over the output shaft 227 by means of a set screw 231. The shaft adapter 229 includes a centrally disposed square recess 233. The shaft adapter 229 is journalled within a shaft housing 235 which is integrally formed with a face plate 237 mounted over the face of the electric motor 225. The shaft housing 235 includes an annular shoulder 239 which encloses shaft adapter 229 within the shaft housing 235. The upper exterior portion 241 of the shaft housing 235 is threaded as indicated, in order that the threaded interior of flexible shaft socket 243 may be threadedly affixed to the upper portion of the shaft housing 235. When the socket 243 and the shaft housing 235 are thus engaged, the rigid, square end 245 of the shaft 247 is received within the square recess 233 of the shaft adapter 229. In order to facilitate the handling of the flexible shaft 154, a stationary casing 250 is provided which envelops the rotating flexible shaft 247 and prevents it from rubbing against either the operator or other parts of the rotopeening apparatus 1.

With reference back to FIGS. 1, 4 and 7, the rotopeening apparatus further includes a frame plate 210 having a pair of expandable collets 252, 253 for mounting the frame plate 210 in firm, abutting relationship against the underside of a tubesheet (not shown) of a nuclear steam generator. The open ends of the heat exchange tubes 4 of such nuclear steam generators are mounted within such tubesheets in an array characterized by a specific square (or triangular) pitch. The expandable collets 252 and 253 are positioned within the frame plate 210 at a distance equivalent to the square (or triangular) pitch of the open ends of these tubes 4 in order that both may be simultaneously inserted into and expanded within such tubes to firmly secure the frame plate 210 against the tubesheet. In the preferred embodiment, Camlock Model 1728E50G02 expandable collets manufactured by Westinghouse Electric Corporation of Pittsburgh, Pa. are used. Such collets may be manually expanded by merely twisting the handles 255, 256. Frame plate 210 further includes three alignment dimples 258, 259 and 260 which are insertable in the recesses between the open ends of the tubes 4 mounted within the tubesheet for insuring that the flexible peening spindle 3 will be properly registrable with and insertable within the open end of the tube 4 to be peened when the expandable collets 252, 253 secure the plate 210 against the tubesheet. Finally, frame plate 210 includes a pair of limit switches 261, 262 for providing an electrical signal indicating that the expandable collets 252, 253 have properly mounted the frame plate 210 against the tubesheet in abutting relationship. The limit switches 261, 262 are connected in parallel to the aforementioned control system (not shown). In the preferred embodiment, the forward corners 264, 265 of the frame plate 210 are recessed as indicated in order to render the apparatus more easily manipulate along the periphery of a tubesheet circumscribed by the bowl of a nuclear steam generator.

Figure 9:
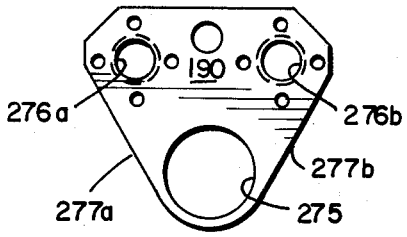
Figure 10:
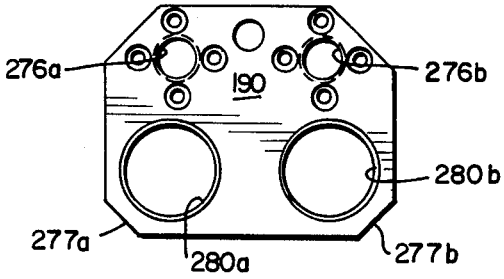
Figure 11:
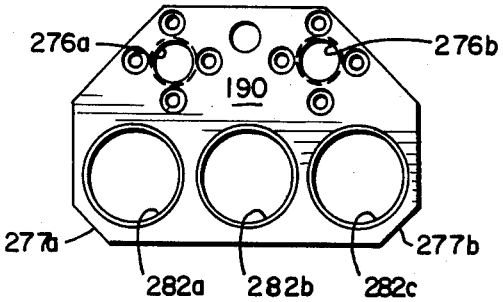

FIGS. 9, 10 and 11 illustrate three separate versions of the tapered connector plate 190 which may be used to connect a peening spindle 3 onto the upper block 184 of the reciprocating mechanism 152 of the oscillatory drive assembly 150. Each of these tapered plates 190 includes a pair of opposed apertures 276*a*, 276*b* which allow the plate 190 to be bolted onto the upper block 184 of the reciprocating mechanism 152. Additionally, the leading shoulders 277*a*, 277*b* of each of these tapered plates 190 are tapered as shown so as to allow the peening spindle 3 carried thereon to be easily manipulated and inserted into the open ends of the tubes 4 adjacent the bowl wall of the nuclear steam generator. As is evident from FIGS. 9, 10 and 11, tapered plate 190 may include one spindle-holding aperture 275, two spindle-holding apertures 280*a*, 280*b*, or three spindle-holding apertures 282*a*–282*c*, respectively. The center lines vary between the spindle-holding apertures 280*a*, 280*b* and 282*a*–282*c* in the plates illustrated in FIGS. 10 and 11 to accommodate the variations in spacing between the open ends of the tubes 4 which result from different angles of approach to these tubes. The apertures 280*a*, 280*b* mount spindles 3 in proper positions when the plate 190 approaches the tubes 4 at a 90° angle relative to the divider plate in the bowl of the generator, while the apertures 282*a*–282*c* mount the spindles 3 in proper positions when the plate 190 approaches the tubes 4 at a 45° angle. It should be noted that alternative mounting bores 290 and 291 are also provided in the mounting plate 210 for alternatively mounting the expandable collets 252, 253 when the device 1 rotopeens peripheral tubes 4 at a 45° angle, rather than a 90° angle.

While the use of two or three of the flexible peening spindles 3 expedites the peening operation, a plate 190 holding more than three peening spindles 3 would generally not be preferred. The flexibility of the spindles 3 makes it difficult for the operator of the rotopeening apparatus 1 to simultaneously register and insert the ends of four or more flexible peening spindles 3 into the open ends of tubes 4 located in an area of difficult accessibility.

PREFERRED METHOD OF THE INVENTION

In the first step of the preferred method of the invention, the flexible peening spindle 3 is inserted into the open end of a tube 4 which is preferably a heat exchange tube mounted in the tubesheet of a nuclear steam generator. As the flexible peening spindle 3 is slid into the tube, the output gearbox of the rotary and orbital drive assembly is actuated so that the flappers 13*a*–13*f* may be fed into the mouth of the tube 4 without binding. As the peening spindle 3 is thus inserted, the expandable collets 252, 253 are placed in registry with and are likewise inserted into the open ends of the regularly arrayed tubes in such a tubesheet. The operator continues to lift the frame plate 210 toward the tubesheet until it becomes engaged against the tubesheet in abutting relationship with the alignment dimples 258, 259 and 260 inserted between the open ends of other tubes which are not presently being peened. The operator then secures the frame plate 210 in this position by manually twisting the knurled handles 255, 256 until the expandable collets secure the frame plate 210 in this position. The operator next checks the output of the serially connected limit switches 260, 261 to ascertain that the plate is in a truly abutting relationship (i.e., not cocked to one side or the other). If the signal from the limit switches 260, 261 is positive, the operator ascertains that the peening spindle 3 is in the upper index position, and then actuates the drive motor 225 of the oscillatory drive assembly. The output gearbox 80 rotates the mandrel 5 and the spindle housing 30 at 3,200 rpms and 15.5 rpms, respectively, via the flexible coaxial shaft 82. Simultaneously, the rocker arm 168 of the reciprocating mechanism 152 reciprocates the flexible peening spindle 3 at a rate of between 27 to 32 cycles per minute, at an amplitude of approximately 0.65 inch. It is important that the oscillatory frequency be chosen so as to be an odd multiple of the orbital frequency, to avoid a condition where the peening balls 18 of the flappers 13*a*–13*r* repeatedly strike the same helical paths they trace throughout the amplitude of the oscillation. Such an interference pattern between the orbital and oscillatory cycles and could create regions of localized stress along the helical paths traced by the peening balls 18 during the peening operation, which could defeat the purpose of the peening operation. A peening oscillatory amplitude of 0.65 inch is preferred because such an amplitude provides a sufficient overlap between peening patterns traced by the peening flappers 13*a*–13*r*, and thus insures a uniform pattern of peening in the longitudinal sections of the tube 4 in the vicinity of the peening flappers 13*a*–13*r*.

In the case of nuclear steam generator tubes formed from Inconel 600, the inner walls of these tubes 4 are peened to an Almen intensity of approximately 10A if the foregoing parameters are continuously sustained for a period of approximately four minutes at a flapper stand-off distance of between 60 to 200 mils. Such a peening intensity has been found to relieve a substantial amount of tensile stress from the inner wall of such tubes 4 without imposing new stresses on the outer walls of the tubes 4 to any significant extent. At the end of the four-minute period, the operator switches off the output gearbox 80 of the rotary and orbital drive assembly and the drive motor 225 of the oscillatory drive assembly 150, and lowers the peening spindle to the lower index position by rotating semi-circular shaft 196 of the index lock shaft assembly 194 in the manner previously described, sliding the lower block 176 downwardly until the semi-circular shaft 196 is aligned with the semi-circular recess 200*b* (not shown) in the drive rod 186, and rotating this shaft 196 back into its locking position by means of crank 198. The process is then repeated for another four-minute interval, which in turn effectively peens (and hence stress-relieves) the entire length of the tube 4 extending through the tubesheet of the nuclear steam generator. It should be noted that the precise rotational speed parameters, oscillation amplitude, stand-off distance and peening time will vary in accordance with the inner diameters of the tubes being peened, the specific alloy forming the tubes, and the amount of tensile stress present around the inner wall of the tubes. Additional information about the interrelationship of these parameters is present in the specification of U.S. patent application Ser. No. 731,256, entitled "Rotopeening Method" by Andrew Wowczuk et al, filed on the same day as the present application and assigned to Westinghouse Electric Corporation, the entire specification of which is incorporated herein by reference.

We claim as our invention:

1. An apparatus for rotopeening the inside wall of a conduit, comprising:

(a) at least one peening spindle having a flexible, rotatable and reciprocable housing, wherein said housing includes a lateral opening, but has an otherwise substantially continuous outer surface;

(b) a flexible mandrel contained within the housing having at least one peening means operatively connected thereto, and (c) bearing means located within and supported by the housing for rotatably mounting the mandrel within the housing off-center relative to the longitudinal axis of the housing and with said peening means in alignment with said lateral opening of said housing so that said peening means rotates, orbits and reciprocates within the conduit when said mandrel and housing are rotated and reciprocated.

2. The apparatus of claim 1, wherein said flexible housing is formed from a plurality of articulated joints.

3. The apparatus of claim 2, wherein said flexible housing is formed from a plurality of serially connected dog-leg joints.

4. The apparatus of claim 1, further including a rotary and orbital drive means which is remotely coupled to said flexible housing and said mandrel for rotating said housing and mandrel.

5. The apparatus of claim 4, further including a flexible drive shaft for remotely coupling said flexible housing and mandrel to said rotary and orbital drive means.

6. The apparatus of claim 1, further including an oscillatory drive assembly for reciprocating the peening means of the peening spindle within the conduit while said peening means rotates and orbits within the conduit.

7. The apparatus of claim 6, wherein said oscillatory drive assembly includes an indexing and reciprocating mechanism, and wherein said spindle is connected to said mechanism by means of a tapered frame.

8. The apparatus of claim 6, further including a frame for supporting said spindle and said oscillatory drive assembly.

9. The apparatus of claim 8, further including a means for driving said oscillatory drive assembly, and means for remotely coupling said oscillatory drive assembly with said drive means.

10. An apparatus for rotopeening the inside wall of a conduit, comprising a peening spindle which includes a rotatable, reciprocable and flexible housing which is insertable within a conduit, said housing being formed from a plurality of articulated joints, wherein one of said joints has a lateral opening but an otherwise substantially continuous surface and at least one rotatable peening means journalled within the housing by a bearing means located within and supported by the housing, wherein said bearing means also aligns the peening means with said lateral opening, whereby said peening means orbits about the longitudinal axis of the conduit and peens its inside wall when the housing and peening means are rotated and reciprocated.

11. The apparatus of claim 10, further including a rotary and orbital drive assembly for rotating said peening means and said flexible housing within the conduit, and means for remotely coupling said rotary and orbital drive assembly to said housing and peening means.

12. The apparatus of claim 10, wherein said flexible housing is formed from a plurality of dog-leg joints.

13. The apparatus of claim 10, further including an oscillatory drive assembly for reciprocating said spindle, and wherein said spindle is connected to the oscillatory drive assembly by means of a tapered frame.

14. The apparatus of claim 10, further including an oscillatory drive assembly for reciprocating said spindle which has an indexing and reciprocating mechanism, and wherein said spindle is connected to said indexing and reciprocating mechanism by means of a tapered frame.

15. The apparatus of claim 10, further including an oscillatory drive assembly for reciprocating said spindle within a conduit, and a drive means for driving the oscillatory drive assembly which is remotely coupled thereto.

16. The apparatus of claim 15, further including a flexible shaft for remotely coupling said oscillatory drive assembly to said drive means therefor.

17. The apparatus of claim 14, wherein said tapered frame has means for mounting said spindle in the vicinity of an open end of the conduit to be peened.

18. The apparatus of claim 17, wherein said tapered frame includes means for signaling when said frame has mounted said spindle in the vicinity of an open end of the conduit to be peened.

19. A rotopeening apparatus for rotopeening tubes having open ends, comprising:

(a) a peening spindle having a flexible, rotatable, reciprocable and substantially cylindrical housing which is inserted within the open end of the tube, wherein said housing includes a lateral opening but an otherwise substantially continuous outer surface, a mandrel contained within said housing wherein said mandrel includes at least one peening means, and bearing means located within to said housing for rotatably mounting the mandrel in an off-center relationship relative to the longitudinal axis of the housing with said peening means in alignment with said lateral opening so that the peening means rotates and orbits within the tubes when the mandrel and housing are rotated;

(b) a rotary and orbital drive assembly for rotating and orbiting the peening means, and (c) means for remotely coupling the housing and peening spindle to the rotary and orbital drive assembly.

20. A rotopeening apparatus particularly adapted for rotopeening heat exchange tubes having open ends of limited accessibility, comprising:

(a) a peening spindle having a flexible, rotatable and generally cylindrical housing which is insertable within said open ends of said tubes, and a flexible mandrel contained therein having at least one peening means operatively connected thereto, and means for rotatably mounting the mandrel in off-center relationship relative to the longitudinal axis of the housing so that the peening means rotates and bearing orbits within the tube when the mandrel and housing are rotated;

(b) a rotary and orbital drive assembly remotely coupled to said mandrel and said flexible housing for rotating and orbiting the peening means within said tubes;

(c) an oscillatory drive assembly including an indexing and reciprocating mechanism for indexing and reciprocating said spindle within said tubes;

(d) a frame for supporting the indexing and reciprocating mechanism, a tapered plate for connecting the spindle to the frame, and (e) a drive means remotely coupled to said indexing and reciprocating mechanism.

21. The rotopeening apparatus of claim 22, further including first and second flexible shafts for remotely coupling said rotary and orbital drive assembly with said mandrel and flexible housing of said spindle, and said drive means to the indexing and reciprocating mechanism, respectively.

22. The rotopeening apparatus of claim 20, wherein said rotary and orbital drive assembly includes a first output shaft for rotating said housing, and a second output shaft concentrically disposed within the first for rotating said mandrel, and further including a coaxial, flexible shaft for remotely coupling said first and second output shafts with said housing and said mandrel, respectively.

23. The rotopeening apparatus of claim 20, further including means for positioning said frame so that said spindle is alignable with and insertable into one of said open ends of said tubes.

24. The rotopeening apparatus of claim 20, wherein said tube ends are mounted in the periphery of a tubesheet, and further including means for detachably mounting said frame in abutting relationship with said tubesheet so that said flexible spindle is alignable with and insertable into one of said tube ends.

25. The rotopeening apparatus of claim 24, wherein said means for detachably mounting said frame includes at least one expandable collet which is insertable into and expandable within one of said tube ends in said tubesheet.

26. The rotopeening apparatus of claim 24, further including at least one limit switch for generating a signal when said frame has been mounted in abutting relationship with said tubesheet.

27. The rotopeening apparatus of claim 24, further including two serially connected limit switches for conducting electric current whenever the top of said frame has been mounted in abutting relationship with said tubesheet.

28. The rotopeening apparatus of claim 20, wherein said indexing and reciprocating mechanism includes a crank and rocker means slidably mounted on said frame.

29. A rotopeening apparatus particularly adapted for rotopeening heat exchange tubes having open ends mounted in the periphery of a tubesheet, comprising:

(a) a peening spindle having a flexible, rotatable and generally cylindrical housing which is insertable within said open ends of said tubes, and a flexible mandrel contained therein having at least one peening means operatively connected thereto, and means for rotatably mounting the mandrel in off-center relationship relative to the longitudinal axis of the housing so that the peening means rotates and orbits within the tube when the mandrel and housing are rotated;

(b) a rotary and orbital drive assembly remotely coupled to said mandrel and said flexible housing for rotating and orbiting the peening means within said tube;

(c) an oscillatory drive assembly including an indexing and reciprocating mechanism for indexing and reciprocating said spindle within said tube;

(d) a frame for supporting the indexing and reciprocating mechanism, a tapered plate for connecting the spindle to the frame;

(e) means for detachably mounting said frame in abutting relationship with said tubesheet so that said flexible spindle is alignable within and insertable into one of said tube ends;

(f) a drive means remotely coupled to said indexing and reciprocating mechanism, and (g) at least one limit switch for generating a signal when said frame has been mounted in abutting relationship with said tubesheet.

30. The rotating apparatus of claim 29, further including two serially connecting limit switches for conducting electric current whenever the top of said frame has been mounted in abutting relationship with said tubesheet.

31. An apparatus for rotopeening the inside wall of a conduit, comprising a peening spindle which includes a rotatable, reciprocable and flexible housing which is insertable within a conduit, wherein said housing includes a lateral opening; at least one rotatable peening means journalled within the housing by a bearing means located within the housing so that said peening means is aligned with said lateral opening, and orbits and rotates about the longitudinal axis of the conduit and peens its inside wall when the housing and peening means are rotated, wherein the outer wall of said flexible housing substantially surrounds said rotatable peening means.

* * * * *